US007185520B2

(12) United States Patent
Pampel et al.

(10) Patent No.: US 7,185,520 B2
(45) Date of Patent: Mar. 6, 2007

(54) DYNAMIC THICKNESS CORRECTION

(75) Inventors: Michael Pampel, Neuss (DE); Günter Pampel, Neuss (DE); Manfred Jeude, Leiehlingen (DE)

(73) Assignee: Aluminium Norf GmbH, Neuss (DE)

( * ) Notice: Subject to any disclaimer, the term of this patent is extended or adjusted under 35 U.S.C. 154(b) by 0 days.

(21) Appl. No.: 10/521,980

(22) PCT Filed: Jul. 20, 2003

(86) PCT No.: PCT/EP03/07468

§ 371 (c)(1),
(2), (4) Date: Sep. 12, 2005

(87) PCT Pub. No.: WO2004/009261

PCT Pub. Date: Jan. 29, 2004

(65) Prior Publication Data

US 2006/0123861 A1 Jun. 15, 2006

(30) Foreign Application Priority Data

Jul. 20, 2002 (DE) ..... 102 33 118

(51) Int. Cl.
*B21B 37/18* (2006.01)

(52) U.S. Cl. ..... 72/9.4; 72/9.2; 72/11.8; 72/240

(58) Field of Classification Search ..... 72/9.2, 72/9.4, 11.8, 205, 240, 248
See application file for complete search history.

(56) References Cited

U.S. PATENT DOCUMENTS 3,015,974 A * 1/1962 Orbom et al. ..... 72/9.2

(Continued)

FOREIGN PATENT DOCUMENTS

JP 57181711 A * 11/1982

(Continued)

OTHER PUBLICATIONS

Ricciatti R. L. et al: "Laser Velocimetry" Iron and Steel Engineer, Association of Iron and Steel Engineers, Pittsburgh, US, vol. 73, No. 6, (Jun. 1, 1996).
International Search Report for PCT/EP03/07468 (in English and German).

*Primary Examiner*—Dmitry Suhol
(74) *Attorney, Agent, or Firm*—Proskauer Rose LLP

(57) ABSTRACT

The invention relates to a method and a device for correcting the thickness of a metal strip during rolling comprising a roll stand with adjusting elements to regulate the thickness of the strip and at least one take-up coiler. The object to provide a method and a device to correct the thickness of a metal strip during rolling using a roll stand which ensures the production of rolled strip with a reduced thickness tolerance is solved according to method by the fact that an average strip thickness of a strip section is determined from at least one strip length measurement and the measurement of the dedicated rotation of the take-up coiler and the adjusting elements of the roll stand are controlled at least depending on the average strip thickness of the strip section. With the method according to the invention the adjusting elements can be controlled almost independently of the ambient conditions of the roll stand so that the thickness tolerances of the rolled strip can be effectively reduced.

11 Claims, 3 Drawing Sheets

U.S. PATENT DOCUMENTS 3,022,688 A 2/1962 Sims
3,049,036 A * 8/1962 Hull et al. ..... 72/9.4
3,427,836 A * 2/1969 Fetner ..... 72/9.4
3,540,247 A 11/1970 Diolot
3,636,743 A * 1/1972 Murtland, Jr. ..... 72/9.4
4,548,063 A * 10/1985 Cox ..... 72/9.4
4,905,491 A * 3/1990 Starke et al. ..... 72/8.6

FOREIGN PATENT DOCUMENTS

JP 62 124011 11/1987
JP 01113102 A * 5/1989

* cited by examiner

DYNAMIC THICKNESS CORRECTION

BACKGROUND OF THE INVENTION

The invention relates to a method and a device for correcting the thickness of a metal strip during rolling comprising a roll stand with adjusting elements to regulate the thickness of the strip and at least one take-up coiler.

During the rolling of metal strip, for example, strip made of aluminium or an aluminium alloy, in order to reduce their thickness after passing through a roll stand, the rolled metal strips are wounded onto a take-up coiler as a coil. One important quality feature of the rolled strip wound as a coil is among other things the thickness of the strip and its fluctuations.

The thickness of the metal strip has hitherto been measured using a radiometric measuring method and the adjusting element of the roll stand controlled depending on this value. In the radiometric measuring method, a detector arranged on one side of the metal strip is used to measure the radiation transmitted by the metal strip from an emitter arranged on the other side of the metal strip. The radiation measured by the detector is in this case dependent on the absorption in the metal strip which is especially determined by the thickness of the metal strip. The deviation of the radiometrically determined strip thickness from a desired value of the strip thickness is used as an input quantity for controlling adjusting elements of the roll stand to influence the thickness of the metal strip. However, the radiometrically determined measured thickness is dependent on further variables, for example, the alloy composition of the strip, the air density and air temperature in the measurement path, for example during blowing out or sucking in heated air, the fraction of coolant and lubricant mist in the measurement path, as well as the temperature of the rolled material and the system components to determine the thickness. Thus, it is absolutely essential to determine the variables and standardise the radiometric measuring method to the additional variables.

A disadvantage with the conventionally known method for correcting the strip thickness of a metal strip during rolling is that a determination of the variables and standardisation of the radiometric measuring method to these variables cannot take place comprehensively under rolling conditions. Thus, to correct the alloy-dependent absorption behaviour of the metal strip, it is necessary to measure the alloy composition on a casting sample by means of spark spectrometry and to calculate therefrom an absorption index for the alloy which is taken into account in the radiometric measuring method. Variations during sampling and measurement uncertainties during the spark spectrometry have the result that the radiometrically determined thickness is provided with a confidence interval which is to be taken into account according to the product requirement.

In order to standardise the radiometric measured values, on the one hand the electrical zero point of the detector signal with the emitter aperture closed is used and on the other hand, under full irradiation, that is without a sample in the measuring path, a balancing factor is determined which takes into account the absorption conditions in the measuring section at this time. This takes place automatically during changing the coil or every time the emitter aperture is open without measured material. The temperature variation in the measurement path with the rolled material is determined by measuring the temperature variation and an empirical weighting factor determined therefrom. It is not possible to record the integral temperature profile in the measurement path which exhibits substantial variations during rolling as a result of the hot rolled strip. Thus, the integral temperature profile cannot be taken into account during the radiometric thickness measurement.

Furthermore, in systems known from the prior art for verifying the radiometric measuring point, control standards are located in a hermetically encapsulated area in the immediate vicinity of the emitter, i.e., metal sheets whose absorption properties do not vary except as a result of temperature variations. By verifying the measured thickness values of these control standards, the absorption curve entered into the measuring system can be corrected. However, this adjustment can likewise only be made when the rolling process is interrupted.

As a result of the disadvantages of the hitherto known methods for correcting the thickness of a metal strip during rolling, which have been described above, the thickness tolerances currently required can only be met with difficulty.

SUMMARY OF THE INVENTION

Starting from the prior art described previously, it is the object of the present invention to provide a method and a device for correcting the thickness of a metal strip during rolling using a roll stand, which ensures the production of rolled strips having a reduced thickness tolerance.

According to a first teaching of the present invention, the object derived and indicated previously is solved according to method in that an average strip thickness of a strip section is determined from at least one strip length measurement and the measurement of the dedicated rotation of the take-up coiler and the adjusting elements of the roll stand are controlled at least depending on the determined average strip thickness of the strip section. In this case, use is made of the fact that the average layer spacing of the strip on the take-up coiler is linked to the measured strip length and take-up coiler rotation from which the average strip length can be determined by means of a fill factor. The required measurement of the strip length and the take-up coiler rotation are in this case almost independent of the variables of the radiometric thickness measurement so that a measured value of the average strip thickness of a strip section, independent of the ambient conditions of the roll stand, is provided. It has been shown that even after short strip lengths a sufficiently accurate value for the average strip length can be determined. By controlling the adjusting elements at least depending on the determined average thickness of the strip section, a reduction in the thickness tolerances of the rolled strip can thus be achieved.

If the strip thickness is additionally measured radiometrically and the adjusting elements of the roll stand are controlled depending on a radiometric strip thickness corrected using the average strip thickness, it is possible according to a next further embodiment of the invention to dynamically correct the radiometrically determined strip thickness using the determined average strip thickness and to control the adjusting elements of the roll stand depending on the dynamically corrected strip thickness value. Thus, an input quantity is available to control the strip thickness during rolling of a metal strip which on the one hand makes it possible to almost instantaneously influence the adjusting elements and on the other hand can be corrected depending on the typical variables of the radiometric determination of the strip thickness during the rolling process.

According to an advantageously further developed embodiment of the method according to the invention, a particularly high accuracy in the measurement of the strip length during rolling is achieved by measuring the strip length using the laser Doppler velocimetry method. The laser Doppler velocimetry method (LDV method) is a standard method for measuring flow velocities. The principle consists in analyzing the scattered light of a particle which passes through a system of interference fringes produced by a laser source. The frequency of the received signal is then proportional to the particle velocity. If the system of interference fringes is imaged on the rolled strip, the speed of the rolled strip can be determined very exactly by analyzing the scattered light. Thus, a highly accurate strip length measurement is available to determine the average strip thickness of a strip section.

If according to a next further developed embodiment, the rotation speed of the take-up coiler is measured using a high-resolution incremental sensor on the axis of the take-up coiler or the axis of the take-up coiler motor, the rotation speed of the take-up coiler, required to determine the average strip thickness, can be determined simply with sufficient accuracy.

An advantageous embodiment of the method according to the invention is obtained in that a plurality of values for the average strip thickness of the same strip section is measured by selecting a plurality of different starting points and strip lengths to be measured to determine the average strip thickness. By means of this measure it is possible to carry out a statistical evaluation of the values of the average strip thickness of a strip section and reduce the measurement error when determining the average strip thickness of a strip section so that the thickness tolerances of the rolled strip can be further reduced.

According to a further developed embodiment of the method according to the invention, the influence of the coiling process on the fill factor can be taken into account in that the values for the average strip thickness of the same strip section are additionally smoothed with variable weighting depending on the actual coil diameter of the strip on the take-up coiler. It can hereby be prevented that, especially at the beginning of the coiling process, fluctuations of the coil diameter have a stronger influence on the determination of the average strip thickness.

The process reliability of determining the average strip thickness can be further increased according to an advantageous embodiment of the method according to the invention by carrying out at least one further redundant strip length measurement.

If, in the event of failure of a first strip length measurement used to determine the average strip thickness, there is an automatic switchover to a further redundant strip length measurement, it can be ensured that the dynamic thickness correction can be carried out continuously even in the event of failure of a strip length measuring system. Thus the rolling process need not be interrupted.

According to a second teaching of the present invention the derived and indicated object is solved by a device for correcting the thickness of a metal strip during rolling using at least one roll stand with adjusting elements to regulate the thickness of the strip, at least one take-up coiler as well as means for measuring the strip length and the extent of the dedicated rotation of the take-up coiler, in that means for controlling the adjusting elements of the roll stand depending on an average strip thickness determined from the measured strip length and dedicated rotation of the take-up coiler are provided. As has been described above, by means of this measure it is possible to measure the strip thickness of a metal strip during rolling approximately independently of the ambient conditions of the roll stand.

According to a further developed embodiment of the device according to the invention, an input parameter for controlling the adjusting elements is available directly after the rolling of the strip if additional means for radiometric determination of the thickness of the metal strip are provided between the roll stand and the take-up coiler. In addition, by controlling the adjusting elements of the roll stand using a radiometrically determined strip thickness value corrected dynamically using the average strip thickness, it is possible that the strip thickness tolerance of the entire strip can be further reduced.

An advantageous embodiment of the device according to the invention is obtained by providing means for redundant measurement of the strip length. On the one hand, the process reliability during rolling can hereby be increased with reference to the failure of a strip length measuring system and on the other hand, by means of the redundant strip length measurement it is possible to verify the respective strip length measurement so that its accuracy can be enhanced.

In addition, the accuracy of the strip length measurement can be further increased in that, according to a further developed embodiment of the device according to the invention, a laser Doppler velocimetry system is provided for measurement of the strip length.

If, according to a next further developed embodiment of the device according to the invention, high-resolution incremental sensors are provided on the axis of the take-up coiler or the axis of the take-up coiler motor, it is possible to determine the rotation of the take-up coiler dedicated to a particular strip length very accurately in a simple fashion.

There are now a plurality of possibilities for advantageously configuring and further developing both the method according to the first teaching of the invention and also the device according to the second teaching of the invention. For this purpose, for example, reference is made on the one hand to the claims subordinate to claims 1 and 10 and on the other hand to the description of a preferred exemplary embodiment in conjunction with the drawings.

DETAILED DESCRIPTION OF THE INVENTION

Figure 1:
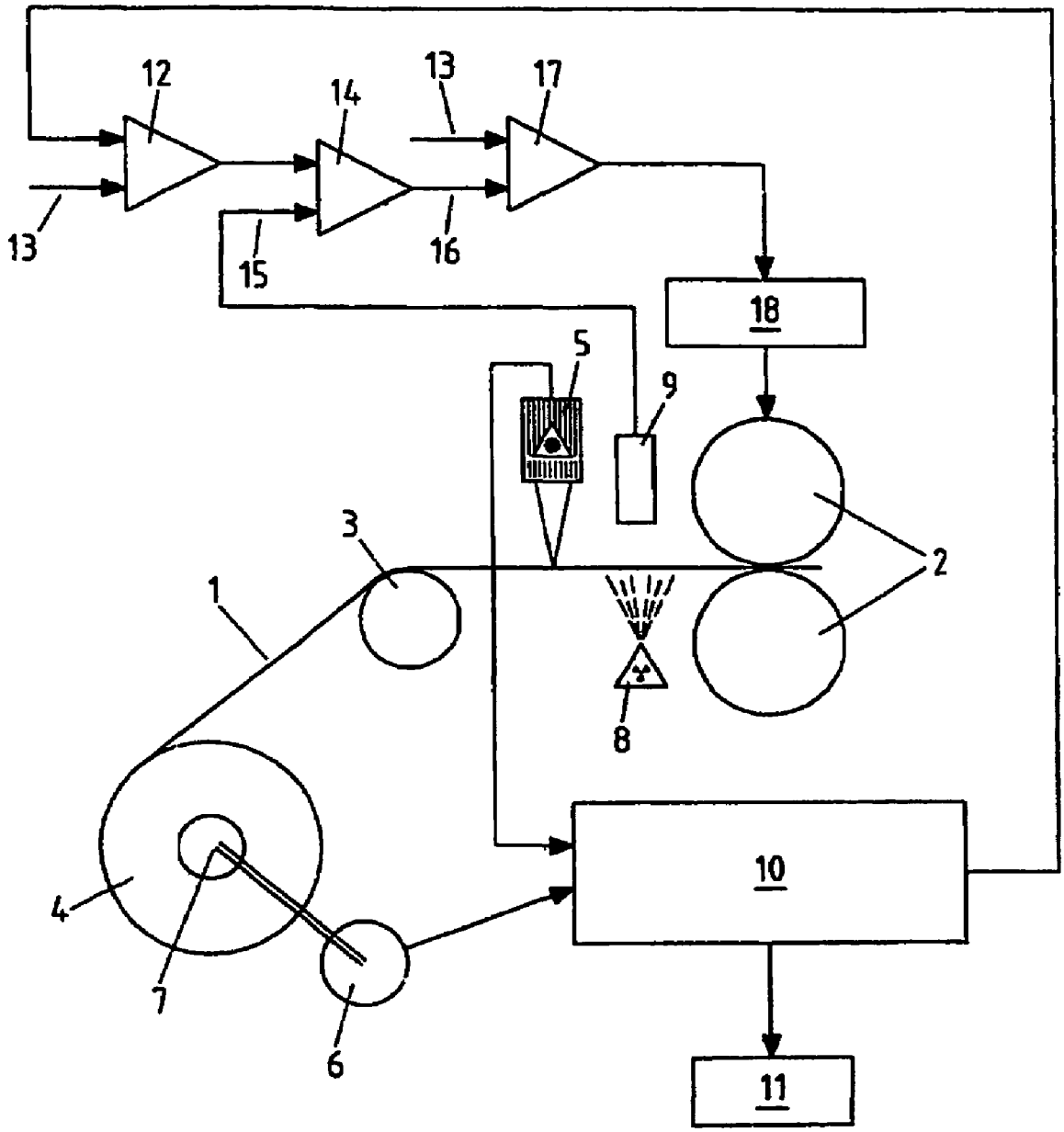
FIG. 1 is a schematic illustration of a first embodiment of a device according to the invention for correcting the thickness of a metal strip during rolling.

The embodiment of a device for correcting the thickness of a metal strip 1 during rolling shown in FIG. 1 comprises a roll stand 2 with adjusting elements not shown for regulating the thickness of the strip 1, a deflecting roll 3 and a take-up coiler 4. Also shown for determining the strip thickness are an LDV system 5 for measuring the strip length, an incremental sensor 6 on the axis of the take-up coiler 7 and an emitter 8 and a detector 9 for radiometric determination of the strip thickness. During rolling, after the metal strip 1 has left the roll stand 2, it is guided around a deflecting roll 3 and coiled onto the take-up coiler 4. An average strip thickness is calculated from the rotation speed of the take-up coiler 4 and the dedicated strip length.

Figure 2A:
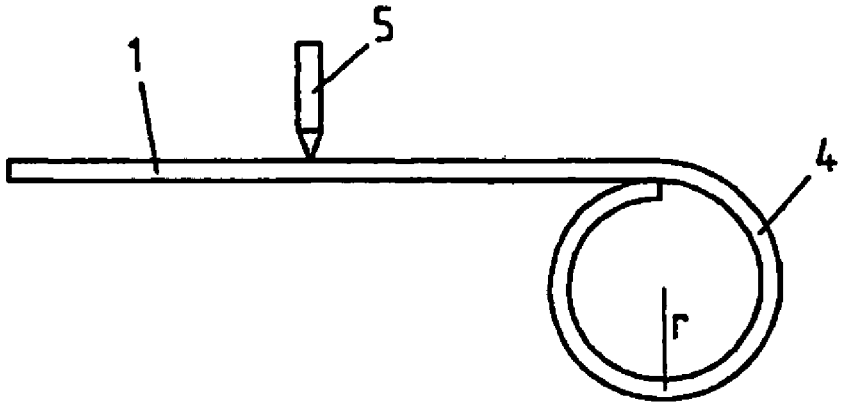
FIG. 2*a* is a schematic illustration showing the method used in the first embodiment to determine the average strip thickness from a strip length measurement.

FIG. 2*a* shows the sequence of the method for determining the average strip thickness of a metal strip 1 in principle using an LDV system 5 and a take-up coiler 4. In this case, the LDV system 5 measures the strip length during coiling of the strip 1 onto the take-up coiler 4 wherein the first layer of the strip 1 has a radius r fixedly pre-determined by the take-up coiler 4 during coiling.

Figure 2B:
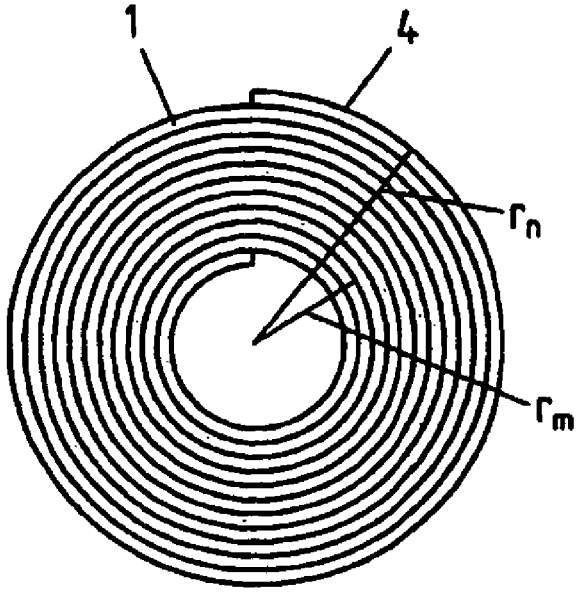
FIG. 2*b* is a sectional view of a take-up coiler with a plurality of coiled layers of a metal strip and FIG. 3: is a block diagram showing the control of a next embodiment of a device for correcting the thickness of a metal strip during rolling.

FIG. 2*b* now shows a sectional view of a take-up coiler 4 with a plurality of coiled layers of a metal strip 1. The average layer spacing h of the wound-on strip 1 is obtained from the difference between the radii $r_m$ and $r_n$ and the number of coiled layers between the radii, that is the dedicated number of rotations of the take-up coiler 4. For the average layer spacing h between two arbitrary winding radii $r_m$ and $r_n$ it thus holds that:

$$h = \frac{\frac{L_n}{n\pi} - \frac{L_m}{m\pi}}{n - m}$$

where $L_n$ is the length running from an arbitrary starting point, n is the dedicated number of the rotation of the take-up coiler 4, $L_m$ is a fixed length from the same starting point and m is the dedicated number of rotations of the take-up coiler 4 for the fixed length $L_m$.

As FIG. 1 shows, the deflecting roller 3 can also be used in principle to measure the strip lengths $L_n$ or $L_m$ but a non-contact and non-slip measurement using the LDV system 5 is to be preferred since a substantially more accurate strip length measurement is achieved. High-resolution incremental sensors 6 arranged on the take-up coiler 7 yield the dedicated number n or m of rotations of the take-up coiler. These measured values are first used to calculate an average layer spacing h using the above formula so that the average strip thickness of a strip section can then be calculated from h with the aid of a fill factor. The average strip thickness is calculated after an adjustable strip length using the computer 10 which on the one hand displays the measured average strip thickness via the display 11 and on the other hand, passes on the value for dynamic thickness correction to a first comparator 12. In the comparator 12 the value of the average strip thickness is compared with the desired thickness 13 of the strip 1 and the difference is passed onto a next comparator 14 as a dynamic thickness variation. The value of the dynamic thickness variation is added to the radiometric strip thickness 15 determined using the emitter 8 and the detector 9 in the comparator 14 and passed on to a further comparator 17 as a dynamically corrected actual thickness 16. Said comparator now determines the control variable for controlling the adjusting elements 18 from the deviation of the dynamically corrected actual thickness 16 from the desired thickness 13. The value of the dynamic thickness correction can be determined sufficiently accurately during the rolling process after short strip lengths, for example, after a coiled strip length of about 50 m. This does not apply to the beginning of the rolling process since in this case, the fluctuations as a result of the coiling process are still too large but in the further course of the rolling process, there is a possibility for correcting the radiometrically determined strip thickness 15 which is independent of the variables of the radiometric strip thickness measurements. By excluding these variables, the adjusting elements of the roll stand 18 can be controlled substantially more accurately which results in a significant reduction in the strip thickness tolerances.

Figure 3:
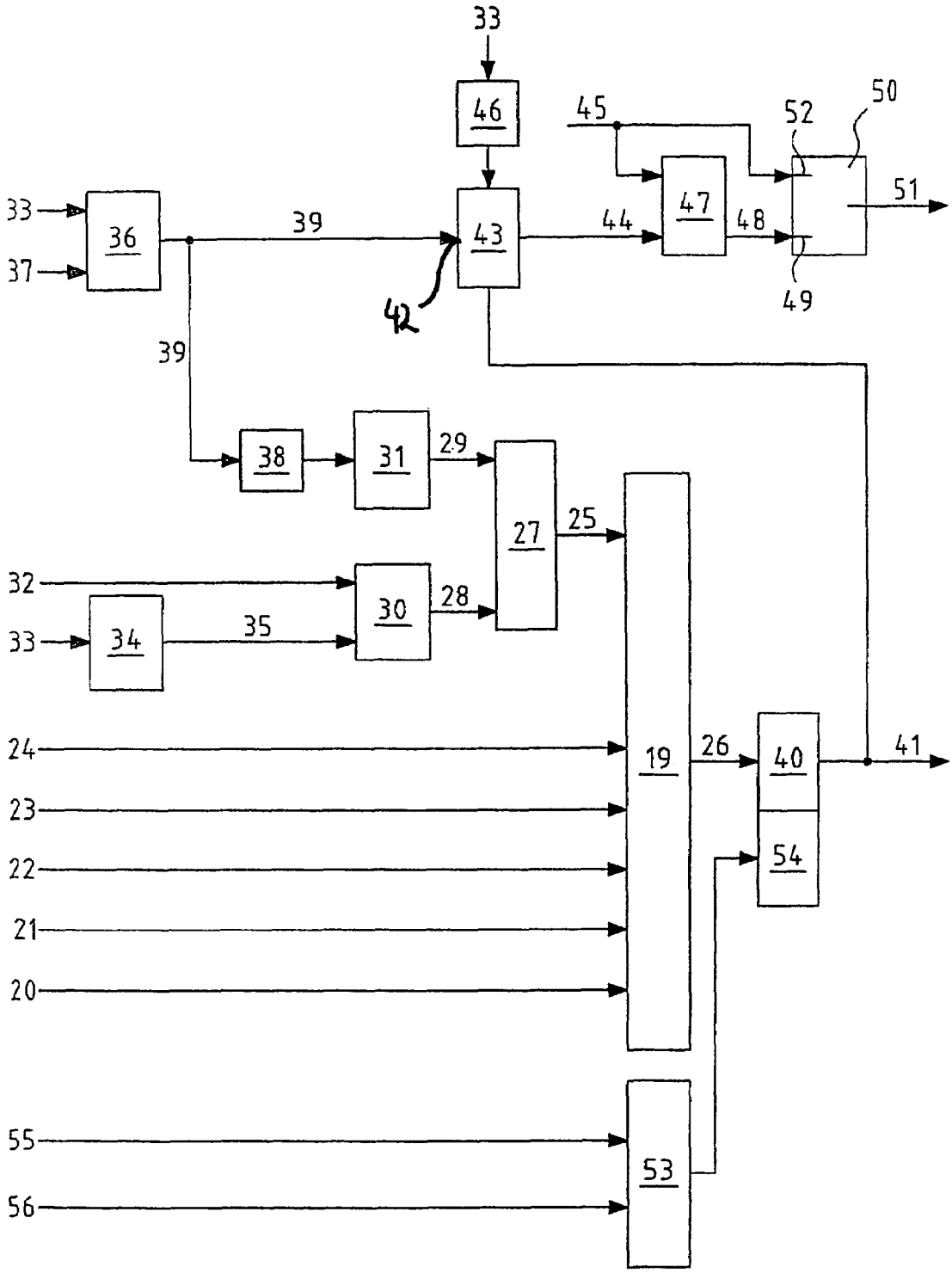

It is also possible to release the correction calculations only under certain parametrisable conditions. The block diagram of the control system of a corresponding exemplary embodiment of a device for correcting the thickness of a metal strip during rolling is shown in FIG. 3. The parameters, quantities and conditions specified hereunder are merely to be regarded as an exemplary configuration of the control system which can vary depending on the rolled material to be produced.

The block diagram shown in FIG. 3 initially has a logic AND gate 19 with 6 inputs 20, 21, 22, 23, 24, 25 and one output 26. Via the inputs 20 to 24, the conditions as to whether the laser is operating, whether the desired thickness is more than 0.8 mm for example, whether data on the alloying of the alloy are deposited in a table, whether manual or automatic operation is selected and whether the strip speed is higher than 100 m/min for example, can be interrogated and used to release the thickness correction. Further conditions can be taken into account via additional inputs at the AND gate 19.

The input 25 of the AND gate 19 is in this case connected to the output of a logic OR gate 27 which for its part has two inputs 28 and 29 which are connected to the output of the comparing elements 30 respective 31. In the comparing element 30 the actual value of the strip length 32 is compared with a starting value of the strip length 35 calculated from the desired thickness 33 by means of a function member 34 and an output signal is delivered to the OR gate 27 as soon as the actual value of the strip length 32 lies above a certain starting value of the strip length 35. The comparing element 31 on the other hand, with the aid of the absolute member 38, compares the absolute value of the difference 39, determined using the difference element 36, between the desired thickness 33 and the average strip thickness 37 determined using the LDV method, with a value dependent on the desired thickness 33. If the absolute deviation is smaller than, for example, 1% of the desired thickness, the output of the comparing element 31 is actuated and a signal is applied to the input 29 of the OR gate 27.

Thus, if the deviation of the average strip thickness 37 from the desired thickness 33 is less than 1% of the desired thickness or the actual value of the strip length 32 is greater than a starting value of the strip length 35, a signal is applied to the input 25 of the AND gate 19. If the inputs 20 to 25 of the AND gate 19 are actuated, the output 41 of the logic circuit is set to "auto correction switched on" via the output 26 of the AND gate 19 with the aid of the setting element 40. At the same time, a signal is applied to the input 42 of the PID element 43. The PID element 43 then determines the dynamic thickness correction 44 of the radiometrically measured actual thickness 46 of the strip from the control deviation applied in the form of the difference 39 between the desired thickness 33 and the average strip thickness 37 determined using the LDV method. However, a comparing element 46 connected to the PID element 43 can prevent the regulation of the PID element 43 if the control deviation 39 is, for example, smaller than 1% of the desired thickness 33.

In the adding element 47 the dynamic thickness correction 44 is now added to the measured actual thickness 45 and is applied to the input 49 of a switch 50 as a corrected actual thickness 48. The output 51 of the switch 50 is in turn directly connected to an input of the control system of the adjusting elements of the roll stand, which is not shown.

If the output 41 of the logic circuit is switched to "auto correction on", and thus a signal is applied to the PID element 43, the switch 50 connects the input 49 to the output 51 and the adjusting elements of the roll stand are controlled with the corrected actual thickness 48. In this case, in the control system of the adjusting elements, which is not shown, the value output via the output 51 is again compared with the desired thickness 33 and the adjusting elements of the roll stand 2 are correspondingly controlled.

In addition, using the switch 50 it is also possible to switch over the control system of the adjusting elements manually to the actual thickness 46 by connecting the output 51 of the switch 50 to the input 52 of the switch 50. Under certain circumstances an automatic switchover to control using the actual thickness 46 can take place, that is if the output 41 is reset via the OR gate 53 of the reset element 54. This is the case if the output 55 of the OR gate 53, which verifies the operating state of the emitter in the outlet or the input 56 of the OR gate 53 which monitors the strip speed falling below a minimum value, carry a signal. By this means, for example, it can be prevented that despite the emitter 8 being switched off in the outlet of the strip 1, an automatic thickness correction is made.

The invention claimed is:

1. A method for correcting the thickness of a metal strip during rolling by a roll stand with adjusting elements to regulate the thickness of the strip and at least one take-up coiler, whereas an average strip thickness of a strip section is determined from at least one strip length measurement and the measurement of the dedicated rotation of the take-up coiler and the adjusting elements of the roll stand are controlled at least depending on the average strip thickness of the strip section, wherein the strip thickness is additionally measured radiometrically and the adjusting elements of the roll stand are controlled depending on a radiometric strip thickness corrected using the average strip thickness.

2. The method according to claim 1, wherein the strip length is measured using the laser Doppler velocimetry method.

3. The method according to claim 1, wherein the rotation speed of the take-up coiler is measured using high-resolution incremental sensors on the axis of the take-up coiler or the axis of the take-up coiler motor.

4. The method according to claim 1, wherein a plurality of values for the average strip thickness of the same strip section is measured by selecting a plurality of different starting points and strip lengths to be measured to determine the average strip thickness.

5. The method according to claim 4, wherein the values for the average strip thickness of the same strip section are additionally smoothed with variable weighting depending on the actual coil diameter of the strip on the take-up coiler.

6. The method according to claim 1, wherein at least one further redundant strip length measurement is made.

7. The method according to claim 6, wherein if a first strip length measurement used to determine the average strip thickness fails, there is an automatic switchover to a further redundant strip length measurement.

8. A device for correcting the thickness of a metal strip during rolling using at least one roll stand with adjusting elements to regulate the thickness of the strip, at least one take-up coiler as well as means for measuring the strip length and the extent of the dedicated rotation of the take-up coiler and means for controlling the adjusting elements of the roll stand depending on an average strip thickness determined from the measured strip length and dedicated rotation of the take-up coiler are provided, especially for implementing a method according to claim 1, wherein means for radiometric determination of the thickness of the metal strip are additionally provided between the roll stand and take-up coiler.

9. The device according to claim 8, wherein means are provided for redundant measurement of the strip length.

10. The device according to claim 8, wherein a laser Doppler velocimetry system is provided for measuring the strip length.

11. The device according to claim 8, wherein high-resolution incremental sensors are provided on the axis of the take-up coiler or the axis of the take-up coiler motor.

* * * * *

UNITED STATES PATENT AND TRADEMARK OFFICE

CERTIFICATE OF CORRECTION

PATENT NO. : 7,185,520 B2
APPLICATION NO. : 10/521980
DATED : March 6, 2007
INVENTOR(S) : Michael Pampel, Günter Pampel and Manfred Jeude It is certified that error appears in the above-identified patent and that said Letters Patent is hereby corrected as shown below:

Column 2
Line 29, insert --a-- between "to" and "method"
Line 36, delete "length" and replace it with --thickness--

Column 5
Line 37, insert --axis of the-- between "the" and "take-up"
Line 38, insert --4-- after "coiler"

Column 6
Line 57, delete "46" and between "thickness" and "of"

Column 7
Line 14, delete "46" and replace it with --45--
Line 17, delete "46" and replace it with --45--
Line 19, delete "output" and replace it with --input--

Signed and Sealed this

Thirty-first Day of July, 2007

JON W. DUDAS
*Director of the United States Patent and Trademark Office*